US007010236B2

(12) United States Patent
Shinkawa et al.

(10) Patent No.: US 7,010,236 B2
(45) Date of Patent: Mar. 7, 2006

(54) EQUIPMENT UNIT WITH IMPERCEPTIBLE INFORMATION RECORDED THEREON BEING USED WITH AN IMAGE FORMING DEVICE AND AN IMAGE FORMING DEVICE COMPRISING THE SAME

(75) Inventors: Kohji Shinkawa, Kitakatsuragi-gun (JP); Hideyuki Nishimura, Katano (JP); Takafumi Nagai, Higashiosaka (JP); Takeshi Murata, Sakai (JP); Keiko Yutani, Ikoma (JP); Hitoshi Nagahama, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/407,227

(22) Filed: Apr. 7, 2003

(65) Prior Publication Data

US 2003/0198480 A1 Oct. 23, 2003

(30) Foreign Application Priority Data

Apr. 19, 2002 (JP) ..... 2002-117044

(51) Int. Cl.
*G03G 15/00* (2006.01)

(52) U.S. Cl. ..... 399/12

(58) Field of Classification Search ..... 399/12, 399/24, 27, 262

See application file for complete search history.

(56) References Cited

U.S. PATENT DOCUMENTS

| | | | | |
|---|---|---|---|---|
| 4,869,532 | A * | 9/1989 | Abe et al. | 283/88 |
| 5,460,646 | A * | 10/1995 | Lazzouni et al. | 106/31.34 |
| 5,983,059 | A * | 11/1999 | Oka et al. | 399/262 |
| 6,651,894 | B1 * | 11/2003 | Nimura et al. | 235/494 |
| 2005/0065234 | A1 * | 3/2005 | Wilson et al. | 523/160 |

FOREIGN PATENT DOCUMENTS

| | | | |
|---|---|---|---|
| DE | 10033320 | A1 * | 2/2002 |
| JP | 06106875 | A * | 4/1994 |
| JP | 7-168513 | A | 7/1995 |
| JP | 411327277 | A * | 11/1999 |
| JP | 2001031895 | A * | 2/2001 |
| JP | 2003013395 | A * | 1/2003 |
| JP | 2003195728 | A * | 7/2003 |
| JP | 2003335040 | A * | 11/2003 |
| WO | WO 9707983 | A1 * | 3/1997 |
| WO | WO 9724278 | A1 * | 7/1997 |

* cited by examiner

*Primary Examiner*—Quana Grainger
(74) *Attorney, Agent, or Firm*—Birch, Stewart, Kolasch & Birch, LLP

(57) ABSTRACT

An equipment unit such as a toner cartridge detachably equipped to an image forming device has a product information related to the equipment unit recorded on the outer surface thereof using an organic pigment having infrared reflectiveness that cannot be observed normally with the naked eye.

15 Claims, 1 Drawing Sheet

EQUIPMENT UNIT WITH IMPERCEPTIBLE INFORMATION RECORDED THEREON BEING USED WITH AN IMAGE FORMING DEVICE AND AN IMAGE FORMING DEVICE COMPRISING THE SAME

This nonprovisional application claims priority under 35 U.S.C. § 119(a) on Patent Application No. 2002-117044 filed in JAPAN on Apr. 19, 2002, which is herein incorporated by reference.

BACKGROUND OF THE INVENTION

The present invention relates to an equipment unit to be attached to an image forming device and an image forming device comprising the equipment unit, and in particular, to various equipment units to be attached to an image forming device and an image forming device comprising the same that is removably attached to the image forming device and used in an image forming process.

DESCRIPTION OF THE RELATED ART

The equipment unit according to the present invention includes any equipment unit that can be detachably mounted to an image forming device and utilized in an image forming process, the examples of which include but are not limited to a photosensitive cartridge comprising a photosensitive body, a charging unit for electrifying the surface of the photosensitive body, a laser irradiation unit (LSU) for irradiating a laser beam on the photosensitive body and forming an electrostatic latent image, a developer storage unit for storing the toner for developing the latent image, a toner cartridge for developing the latent image, a transfer unit for transferring the developed image on the photosensitive body to a recording medium, a fixing unit for fixing the image transferred onto the recording medium, and a cleaning unit for removing the toner adhered to the photosensitive body and the like.

The above-mentioned equipment unit generally bears information related thereto, such as the production lot including the date and location of manufacture, and the serial number etc., so as to facilitate management of the product at the manufacturer. One example of the equipment unit is a toner cartridge used in the image forming device. The toner cartridge body is formed using black or other colored pigments so that stain and scratch marks formed on the outer surface of the cartridge are less obvious, and that the cartridge has sufficient strength. In general, the outer surface of the toner cartridge body bears information related to the product (production lot etc.) that is provided at the manufacturer.

However, since the toner cartridge is colored with black and other colored pigments, the appearance of the toner cartridge is deteriorated if the product information appears on the outer surface of the toner cartridge in a visible manner. The product information recorded on the outer surface of the toner cartridge is not only unnecessary for the user, but may also even annoy the user since it deteriorates the design of the cartridge body. Therefore, the product information useful to the manufacturer may be detrimental to the user.

SUMMARY OF THE INVENTION

The present invention aims at solving the above-mentioned problems of the prior art. The object of the present invention is to provide an equipment unit for an image forming device and an image forming device comprising the equipment unit, the equipment unit (such as a toner cartridge) being detachably mounted on the image forming device having an outer surface capable of bearing product information without causing disadvantage to the user.

In order to achieve the above object, the equipment unit for the image forming device according to the present invention comprises what is disclosed in claims 1 through 10, and the image forming device according to the present invention adopts a structure disclosed in claims 11 through 16. In particular, the equipment unit of an image forming device according to claim 1 of the present invention relates to an equipment unit to be attached to an image forming device for forming images, the unit bearing information recorded thereto by an organic pigment having infrared reflectiveness.

DETAILED DESCRIPTION OF THE PREFERRED EMBODIMENTS

Figure 1:
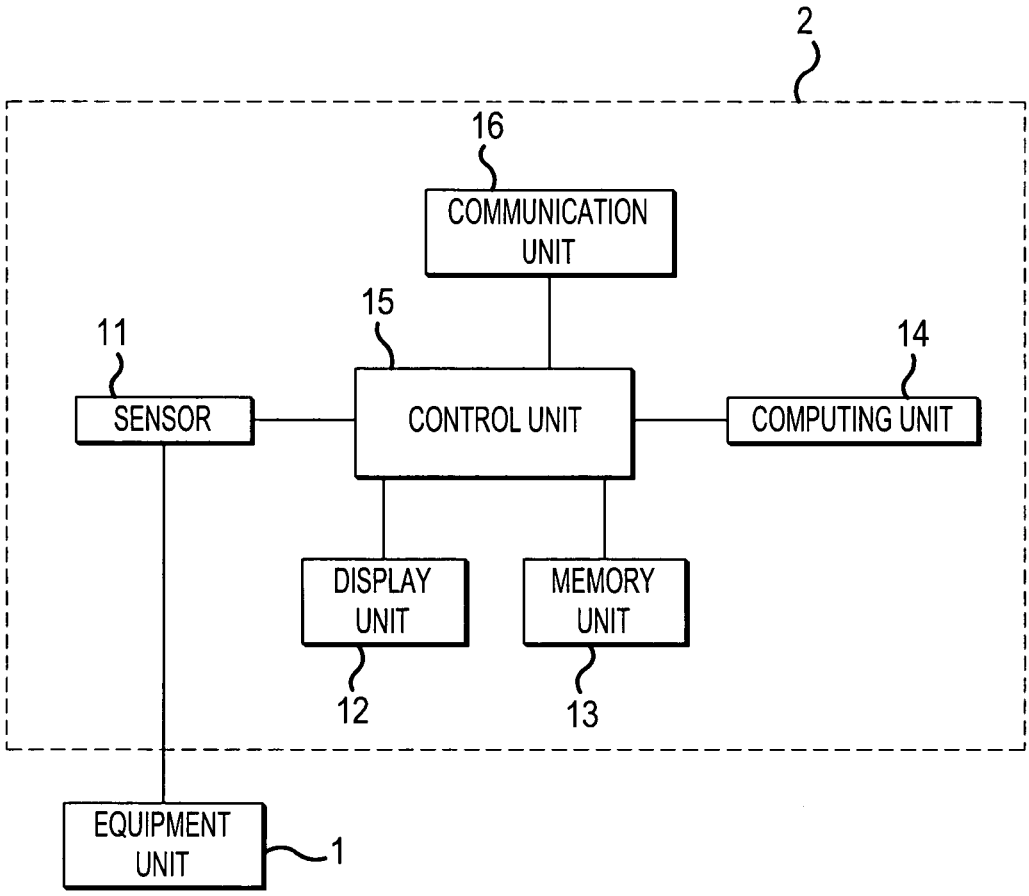
FIG. 1 is a block diagram explaining the processing of information recorded on various equipment units of the image forming device according to the preferred embodiment of the present invention.

We will now explain one preferred embodiment of the present invention.

An equipment unit for an image forming device according to the present embodiment is a developer storage means, such as a toner cartridge or a toner bottle (hereinafter referred to as toner casing), that can be detachably mounted to an electrophotographic image forming device. The toner casing of the present embodiment is colored with pigments such as carbon black, so that stain and scratch marks formed on the outer surface of the cartridge are not obvious.

The outer surface of the toner casing bears information recorded thereto at the manufacturer, such as the product lot including the date and place of manufacture, the name of the product, and the model number of the product. In the present embodiment, the information is recorded using an organic pigment having superior reflectiveness to only infrared radiation (infrared-reflective organic pigment) that cannot be detected in visible radiation and that is concolorous with the body of the toner casing.

There is no limitation to the organic pigment that can be used in the present embodiment, as long as it has superior infrared reflectiveness. There is no limitation to the color of the pigment in the visible radiation region as long as it does not stand out when recorded on the toner casing surface, but black is preferable. One actual example of the organic pigment having infrared reflectiveness used in the present embodiment is an azomethine black organic pigment represented by the following general formula.

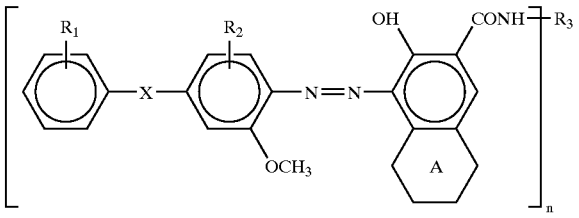

If the organic pigment utilized as a toner in the present image forming device comprising the toner casing has good infrared reflectiveness, the same pigment used in the toner can be utilized as the organic pigment for recording information. If the toner can be used as the organic pigment for recording information, the toner filled in the toner casing that did not meet standards during manufacture of the toner casing or the waste toner collected from the image forming device can be utilized for recording the information. Thus, the toner that has been treated conventionally as waste can be utilized effectively.

As above, the information recorded on the surface of the toner casing using an infrared-reflective organic pigment is not detectable by visible radiation, so it is not visible to the naked eye. Therefore, the appearance of the toner casing is not deteriorated by the recorded information.

On the other hand, the manufacturer can detect the information recorded on the casing with the organic pigment through use of infrared radiation and infrared-transparent filter. Thus, the management of products at the manufacturer is facilitated since the information recorded on the toner casing can be detected either visually or through a detector such as a reader.

The forms of the recorded information are not limited to, but preferably include, a one-dimensional barcode and a two-dimensional Q-code utilized as the standard form for recording information. Through use of barcodes and Q-codes, extensive information can be recorded promptly to a large amount of toner casings. Furthermore, the recording of information is carried out accurately, and the products bearing information can be treated without delay based on the information.

The information recorded on the toner casing includes, but is not limited to, the production lot including the date and place of manufacture, the name of the product, and the model number of the product. If the toner casing body can be reused by supplying toner into the casing according to the frequency of use of the toner, or if the maintenance timing of various component parts of the toner casing differ according to their difference in durability, the number of times that the toner casing is reused or the replacement data etc. can be recorded as information on the casing. By recording the detailed data related to reusability, the recycling of various components in the image forming device can be performed preferably, and the recycling efficiency can be improved.

The information can be recorded directly on the outer surface of the toner casing by use of the organic pigments having infrared reflectiveness. The organic pigments used to record information directly on the toner casing can be wiped off easily using alcohol and other solvents when the toner casing is recycled. Therefore, the cost and work related to peeling off stickers from the casing recording product information and the like when recycling the toner casing can be cut down, and new information can be recorded easily.

The information can also be recorded indirectly on the toner casing, such as by utilizing an ink-like recording agent where the above-mentioned organic pigments are dispersed in a solvent for organic pigments such as water and resin. In an actual example, a recording agent formed by dispersing the organic pigments in a natural wax used as solvent can be utilized to record information directly on the toner casing at room temperature. Further, if a recording agent formed by dispersing the organic pigments in a synthetic resin is used, the recording agent can be heated and melted before being adhered on the toner casing body to thereby record information.

When dispersing the organic pigments in the solvent, the content of the organic pigments in the recording agent is not especially defined as long as good dispersion property and good color are achieved, but preferably, the content of the organic pigments in the recording agent should be between 0.5 weight % and 15 weight %. If the content of the organic pigments falls within this range, the recorded information can be easily read at the manufacturer or at the store either visually or through a sensor.

Depending on the material for forming the toner casing or the position for recording the information, the above organic pigments cannot be adhered easily on the casing surface, and so the information cannot be recorded directly on the surface. In such cases, the information can be recorded indirectly by disposing a recording medium recording information on the surface of the toner casing. Actually, a sticker having the same color as the toner casing is adhered on the toner casing, and information can be recorded on the sticker using the organic pigments. The sticker is concolorous with the toner casing, so the appearance of the casing is not deteriorated. When recycling the toner casing, the organic pigments on the sticker can be removed by alcohol or other solvents, and new information can be recorded thereto with the organic pigments, so there is no need to peel off the sticker and related costs can be cut down.

The present embodiment explained an example where information is recorded on the outer surface of a toner casing (toner cartridge and toner bottle) as equipment unit by use of organic pigments having infrared reflectiveness, but the present invention is not limited by such application. The recording of information using organic pigments can be applied to the outer surface of various equipment units to be attached to an image forming device, including a photosensitive cartridge comprising a photosensitive drum, a charging unit comprising a charger for electrifying the photosensitive drum, a laser irradiation unit (LSU) for irradiating laser beam on the photosensitive drum to form a static latent image, a developing cartridge comprising a developer for developing the latent image, a transfer unit for transferring the image developed on the photosensitive drum to a recording medium, a fixing unit for fixing the image transferred onto the recording medium, and a cleaning unit for removing the toner adhered on the photosensitive drum.

Next, the processing of information recorded on various components of the image forming device is explained with reference to FIG. 1.

As shown in FIG. 1, the image forming device 2 according to the present embodiment comprises a sensor 11 for detecting the information recorded on the various equipment units 1, a memory 13 for storing the information detected through the sensor 11, a computing unit 14 for computing and processing the information stored in the memory 13, a display unit 12 for displaying the information read from the various components, and a control unit 15. The control unit 15 controls the operation of the sensor 11, the display unit 12, the memory 13, the computing unit 14, and a communication unit 16 explained later, and controls the operation of the image forming device based on the read out information.

As explained above, the information recorded using infrared-reflective pigments on various equipment units attached to the image forming device are read through the sensor 11, and stored in the memory. The sensor 11 equipped to the image forming device can be a handy-type sensor mounted to the exterior of the image forming device or a miniature sensor disposed in the image forming device. The information stored in the memory 13 includes information recorded on various equipment units, and the date at which the various equipment units are equipped to the image forming device.

The information stored in the memory 13 is computed and processed at the computing unit 14, and recognized by the image forming device. The image forming device determines whether the equipment unit is a newly attached unit or a used one that has been removed once during use and reattached, and judges whether the attached equipment unit is an adaptive model or not. Moreover, through computing operation, the device calculates the exchange timing of the equipment unit or the number of times the unit can execute image processing operation. These results are reported to the user through the display unit 12 such as the operation panel and the like.

The control unit 15 of the image forming device is capable of setting up the optimum conditions for the image forming processes such as developing, transferring and fixing, based on the status of the various equipment units. For example, the control unit 15 controls the voltage applied to the charger of the charging unit, the bias of the developer unit, the voltage applied to the transfer unit, the power of the laser radiated from the LSU, the processing speed of the image forming process, and the fixing temperature of the fixing unit.

These optimum conditions are controlled through the control unit 15 based on the information read from the various equipment units mounted to the image forming device or the temperature, humidity etc. of the image forming device, so as to allow image forming operation to be executed under the most preferable conditions. Actually, the most preferable conditions for the image forming process is determined based on the information set up according to the manufacturer, so the image forming device should be equipped with a storage means not shown for storing the most preferable conditions of the image forming process set up according to the status of various equipment units.

Furthermore, the image forming device can be equipped with a communication unit 16 for communicating with the computer of the manufacturer through a telecommunication line and the like. By use of the communication unit, the image forming device can communicate with the computer of the manufacturer or the sales agent, through which the image forming device can set up the optimum conditions for the image forming process according to the status of the image forming device.

Moreover, by providing a means for the user to communicate with the manufacturer, the manufacturer can notify the user through the display unit 12 and the like of a recall information when a defective equipment unit product was recalled after being attached to the image forming device.

As explained, if the image forming device of the user is equipped with a means for communicating with the computer of the manufacturer, the status of the image forming device can be notified to the user based on the newest information recognized by the manufacturer. Therefore, the manufacturer can provide to the user an image forming device that is capable of always executing a superior image forming operation. Furthermore, the communication allows the manufacturer to utilize the data for managing the various equipment units and the image forming device itself, and to prevent receiving claims from the user.

EXAMPLE

An ink dispersed in water was prepared using a CHROMOFINE black (product of Dainichiseika Color & Chemicals Mfg. Co. Ltd., product number A-1103) which is an azomethine black organic pigment utilized as the organic pigment having infrared reflectiveness. The content of CHROMOFINE black was 7 part by weight against 1 part by weight of a recording medium. Next, the prepared ink was applied in a barcode-form on the outer surface of the black-colored toner cartridge to record information.

The toner cartridge surface was observed with the naked eye, but the barcode could not be observed. On the other hand, when the toner cartridge surface was visually observed using an infrared-transparent filter, the barcode could be confirmed.

According to the equipment unit to be attached to an image forming device of the present invention, the information related to the equipment unit is recorded on the unit using organic pigments having infrared reflectiveness, so the recorded information cannot be recognized in the visible radiation region. However, the information recoded on the equipment unit can be recognized by utilizing infrared radiation or infrared-transparent filter. As explained, since the above-mentioned organic pigment cannot be observed by the naked eye, information can be recorded on even the letters or images applied as a design on the surface of the equipment unit. Therefore, the information required by the manufacturer in managing the equipment units can be applied to the units without degrading the design of the units.

Since the organic pigments are concolorous with the body of the equipment unit, information recorded on the equipment unit cannot be observed through the naked eye. Thus, the information required by the manufacturer in managing the equipment units can be applied to the units without degrading the appearance of the units.

According to the present invention, a great amount of information can be recorded on the equipment units, and the recording of information can be performed promptly and accurately to a large quantity of equipment units. Further, the recognition and processing of information recorded on the equipment units are performed promptly. Therefore, the manufacturer is capable of managing the equipment units with great efficiency.

The recording of information on the equipment units is facilitated by the use of the above-mentioned organic pigment. Conventionally, information was recorded on the equipment units using a sticker and the like, and the rewriting of information required steps of removing the sticker member, cleaning with alcohol and other solvents the portion on which the sticker was adhered, and putting on a new sticker member. However, according to the present invention, the rewriting of information requires only the steps of wiping off the organic pigment with alcohol and other solvents and then recording information using the organic pigment. According to the present invention, the cost and work related to rewiring information can be cut down.

According further to the present invention, if the equipment unit is formed of a material on which organic pigments hardly adhere and information cannot be recorded directly, the pigments can be dispersed in water, natural wax or resin to allow information to be recorded directly on the unit in room temperature.

Furthermore, the organic pigments have good dispersion and coloring properties. Therefore, the information recorded on the equipment units using the pigments can be read easily through infrared irradiation and use of infrared-transparent filter.

The organic pigments used for recording information on the equipment units can also be used as the component of the developer of the image forming device. Therefore, the developer that did not meet standards or the used developer that was collected from the image forming device can be reused to record information on the equipment units.

According to this feature of the invention, the developer that had been disposed as waste according to the prior art can be utilized effectively.

Furthermore, information can be recorded on the units using infrared-reflective organic pigments, so the information required by the manufacturer for managing the units can be applied to the units without deteriorating the design of the units.

When recycling the equipment unit, the information recorded on the unit with organic pigments can be wiped off with alcohol and other solvents, and new information can be recorded using the organic pigments. Therefore, the cost and work related to rewriting information on the equipment units can be cut down.

Moreover, when recycling the equipment unit, the manufacturer can manage the reusable units effectively since detailed information on the unit, such as the number of times the unit has been recycled or the contents of exchange of parts within the equipment unit, is recorded on the unit. Especially when the equipment unit comprises components whose replacement frequency vary due to their different durability, the manufacturer can recognize the exchange timing of each component accurately during reuse of the equipment unit, so the management of the equipment unit is performed efficiently.

According to the structure of the present image forming device comprising the equipment unit mounted on the device, the information related to the equipment unit mounted on the image forming device is read and processed, so that the status of the equipment units and the mounting date of the equipments etc. can be confirmed easily.

The timing for exchanging the equipment unit, the number of times the unit is capable of executing image forming operation, and the information related to the image forming operation can be computed based on the information recorded on the equipment unit and read through the sensor. Thereby, the present invention provides an image forming device that is capable of executing image forming processes in a preferable manner.

The information related to the image forming device such as the information related to the equipment unit can be displayed on the screen of the operation panel and the like for displaying computed results, so the status of the image forming device can be notified to the user or the manufacturer. Since the user or manufacturer is informed whether the attached equipment unit is a corresponding model or not, or when it is time to exchange the equipment unit, the image forming device can perform the image forming operation in a preferable manner, and the management of the equipment unit is facilitated.

Similarly, the optimum conditions for the image forming processes including developing, transferring and fixing of images can be determined according to the status of the equipment unit and the temperature, humidity etc. of the image forming device. Therefore, the image forming device can perform the image forming operation in a preferable manner, and the formed image has excellent quality.

According to another aspect of the invention, the image forming device can communicate with the computer at the manufacturer via a telecommunication line etc., according to which the image forming operation can be controlled and managed based on the newest information that the manufacturer holds. Thus, the present invention provides to the user an image forming device that can output an excellent quality image. Further, the manufacturer benefits from the present image forming device since they can manage the image forming device in an easier and more timely manner, preventing claims that may arise from users.

The conventional black-colored organic pigments absorb infrared radiation, whereas the black infrared-reflective organic pigments used in the present invention allow information to be recorded on the units in a manner that cannot be observed with the naked eye.

What is claimed is:

1. An equipment unit to be attached to an image forming device for forming an image, comprising:

a casing, wherein the equipment unit casing bears erasable and imperceptible information recorded thereto by using an organic pigment having infrared reflectiveness, wherein said information is recorded via a recording agent formed by dispersing said organic pigment having infrared reflectiveness in water, natural wax or resin, said information is related to the equipment unit and is recorded on the casing in the form of either a barcode or a Q-code, and the content of said organic pigment ranges from 0.5 part by weight to 15 part by weight against 100 part by weight of the recording agent.

2. The equipment unit to be attached to an image forming device according to claim 1, wherein said organic pigment having infrared reflectiveness is concolorous with said equipment unit casing on which the information is recorded.

3. The equipment unit to be attached to an image forming device according to claim 1, wherein said information is related to the equipment unit is recorded on the equipment unit casing either directly or indirectly.

4. The equipment unit to be attached to an image forming device according to claim 1, wherein said organic pigment is contained in a developer used in said image forming device.

5. The equipment unit to be attached to an image forming device according to claim 1, wherein said equipment unit is a unit for storing a developer.

6. The equipment unit to be attached to an image forming device according to claim 1, wherein said equipment unit is recyclable.

7. The equipment unit to be attached to an image forming device according to claim 1, wherein said information recorded on the equipment unit casing includes a recycling information of the unit.

8. An image forming device equipped with an equipment unit, the equipment unit comprising:

a casing that bears erasable and imperceptible information relating to the equipment unit, the information being recorded thereto by using an organic pigment having infrared reflectiveness;

the image forming device comprising:

a sensor for reading said information related to the equipment unit, and a computing unit for computing and processing the information read through said sensor, wherein processing performed by the image forming device is optimized based on the information read.

9. The image forming device according to claim 8, further comprising a display unit for displaying said information related to the equipment unit and a result of operation by said computing unit.

10. The image forming device according to claim 8, further comprising a control unit for controlling image forming processes based on said information related to the equipment unit.

11. The image forming device according to claim 10, wherein said control unit uses said information related to the equipment unit to determine at least one of whether the equipment unit is new, used, or adaptive to the image information device.

12. The image forming device according to claim 8, further comprising a communication unit that can be connected to an external device.

13. The image forming device according to claim 8, wherein the color of said organic pigment is black.

14. A method for providing an equipment unit attachable to an image forming device with information pertaining thereto, comprising:

recording said information on said equipment unit with an organic pigment having infrared reflectiveness, the recording provided on an outer surface of said equipment unit and said information relating to the equipment unit, wherein the recording is erasable and imperceptible to the naked eye, said image forming device:

reading said information related to the equipment, computing and processing the information read, displaying said information along with a result of the computing and processing, and controlling image forming processes based on said displayed information.

15. The method as set forth in claim 14, wherein said recording includes providing an amount of said organic pigment ranging from 0.5 part by weight to 15 part by weight against 1.0 part by weight of a recording agent.

* * * * *